United States Patent [19]

Kenney

[11] Patent Number: 4,951,997

[45] Date of Patent: Aug. 28, 1990

[54] INFANT FEEDING CHAIR

[76] Inventor: Claire L. Kenney, 381 Broad St., Apt. A415, Newark, N.J. 07104

[21] Appl. No.: 355,321

[22] Filed: May 22, 1989

[51] Int. Cl.[5] ..... A47C 7/62

[52] U.S. Cl. ..... 297/188; 297/191; 297/194; 248/102; 248/103

[58] Field of Search ..... 297/250, 188, 191, 194; 248/102, 103, 104

[56] References Cited

U.S. PATENT DOCUMENTS

| | | | |
|---|---|---|---|
| 1,279,323 | 9/1918 | Geisel | 248/103 |
| 1,900,691 | 3/1933 | Carlson | 248/102 |
| 1,970,602 | 8/1934 | Geistlinger | 248/103 |
| 2,064,671 | 12/1956 | Lockaton | 248/103 |
| 3,251,626 | 5/1966 | Martin | 248/103 X |
| 3,635,431 | 1/1972 | Mariner | 248/104 |
| 4,121,797 | 10/1978 | MacNeil | 248/102 |
| 4,315,654 | 2/1982 | Crook | 297/188 |
| 4,473,907 | 10/1984 | Maillard | 248/102 X |
| 4,564,957 | 1/1986 | Scharf | 248/102 |

*Primary Examiner*—Laurie K. Cranmer
*Attorney, Agent, or Firm*—Leon Gilden

[57] ABSTRACT

An infant feeding chair is set forth wherein a chair is provided with a planar seat portion for convenient positioning on a variety of support surfaces and further including a pivotal arm mounted to the seat and provided with a second orthogonal arm movably mounted to said arm. The second arm is provided with a plurality of spaced removable pads with a bottle holder mounted thereto on a pivot formed for limited motion. The bottle holder is mounted to enable a child access to the bottle as desired.

7 Claims, 6 Drawing Sheets

INFANT FEEDING CHAIR

BACKGROUND OF THE INVENTION

1. Field of the Invention

The field of invention relates to infant furniture, and more particularly pertains to a new and improved infant feeding chair wherein the same conveniently orients and disposes a feeding bottle proximate an infant secured to a chair.

2. Description of the Prior Art

The use of infant chairs for a host of purposes is well known in the art. As may be appreciated, chairs of the prior art have been utilized for a host of accessories wherein it is set forth that the infant chair of the instant invention provides for a baby feeding chair of unique versatility, as opposed to prior art devices in the feeding of an infant and for storage of paraphernalia associated therewith. Examples of prior art devices that have been utilized for feeding of infants are to be found in various examples of the prior art, including U.S. Pat. 1,279,323 to Geisel. The patent sets forth a bracket arangement for securement to a crib or the like wherein an elongate arm adjustably mounted to the bracket secures a bottle thereto for grasping by an infant.

U.S. Pat. No. 1,970,602 to Geistlinger sets forth a nursing bottle holding arrangement wherein a variation of a crib securement bracket over that of the Geisel patent is set forth. The bracket provides for a multi-articulatable arm supportingly carrying a bottle in a downwardly oriented position relative to an infant to enhance feeding of the infant.

U.S. Pat. No. 2,064,671 to Lockaton sets forth another example of a crib supported nursing device wherein an arm securable to a vertical post of an associated infants crib is provided with a multi-articulated arm in the same essence as the other prior art devices noted above to provide feeding of an infant.

U.S. Pat. No. 4,121,797 to MacNeil sets forth a chair provided with a plurality of upstanding flanges on the other side of a chair for supporting a cross bracket which in turn supports a nursing bottle for an infant. The MacNeil patent fails to provide the safety arm arrangement as set forth by the instant invention providing for a padded arm to maintain an infant within the chair, as opposed to the MacNeil patent, and further provides for a pivotally mounted bottle to accommodate an infant seated in the chair.

U.S. Pat. No. 4,315,654 to Crook sets forth a support means in association with a chair rigidly orienting a bottle for nursing relative to an infant to ostensibly enable an infant access to the bottle for feeding.

As such, it may be appreciated that there continues to be a need for a new and improved infant feeding chair which overcomes the problems of convenience and adaptability in use, and in this respect the present invention substantially fulfills this need.

SUMMARY OF THE INVENTION

In view of the foregoing disadvantages inherent in the known types of infant feeding chairs now present in the prior art, the present invention provides an infant feeding chair wherein the same conveniently associates a nursing bottle with an infant and further enables storage of the feeding paraphernalia to enable use of the chair by an infant in a conventional manner. As such, the general purpose of the present invention, which will be described subsequently in greater detail, is to provide a new and improved infant feeding chair which has all the advantages of the prior art infant feeding chairs and none of the disadvantages.

To attain this, the present invention comprises an infant feeding chair formed with a relatively planar base for positioning over support surfaces wherein the chair provides for safety belts as well as a pivotally mounted brace member comprising first and second arms wherein the second arm includes an infant bottle securably fastenable thereto and pivotally mounted to the arm to enable feeding of an infant seated within the chair. The second arm further includes a pad means for maintaining an infant within the chair during a feeding procedure. Further, a storage compartment is positioned and associatable within the chair for storage of infant paraphernalia.

My invention resides not in any one of these features per se, but rather in the particular combination of all them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant feeding chair which has all the advantages of the prior art infant feeding chairs and none of the disadvantages.

It is another object of the present invention to provide a new and improved infant feeding chair which may be easily and efficiently manufactured and marketed.

It is a further object of the present invention to provide a new and improved infant feeding chair which is of a durable and reliable construction.

An even further object of the present invention is to provide a new and improved infant feeding chair which is susceptible of a low cost of manufacture with regard to both materials and labor, and which accordingly is then susceptible of low prices of sale to the consuming public, thereby making such infant feeding chairs economically available to the buying public.

Still yet another object of the present invention is to provide a new and improved infant feeding chair which provides in the apparatuses and methods of the prior art some of the advantages thereof, while simultaneously overcoming some of the disadvantages normally associated therewith.

Still another object of the present invention is to provide a new and improved infant feeding chair wherein the same is provided with a brace member for pivotally mounting a nursing bottle relative to an infant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
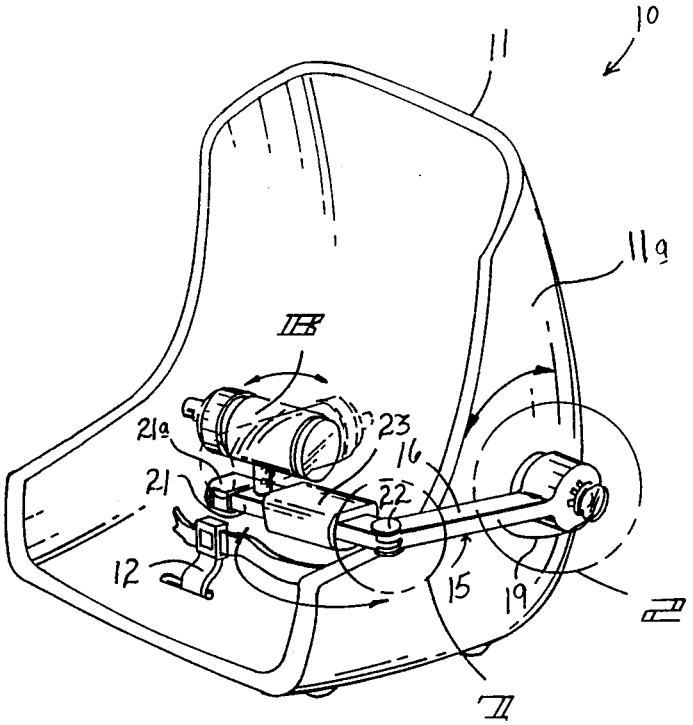
FIG. 1 is an isometric illustration of the instant invention.

With reference now to the drawings, and in particular to FIGS. 1 to 11 thereof, a new and improved infant feeding chair embodying the principles and concepts of the present invention and generally designated by the reference numeral 10 will be described.

More specifically, the infant feeding chair 10 of the instant invention comprises an infant seat 11 of a generally curvilinear "L" shaped configuration including a convex back formed with planar parallel sides 11*a* formed to a forwardly extending planar seat. The infant seat 11 includes a seat harness 12.

Figure 3:
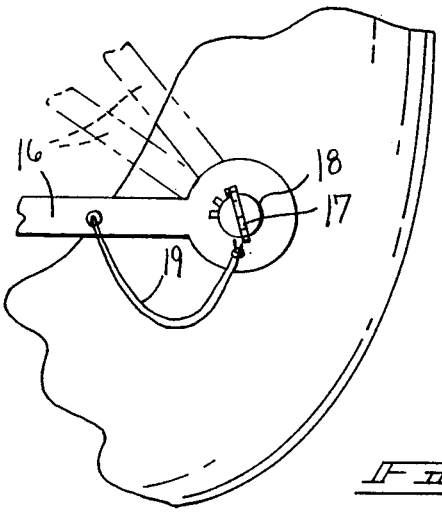
FIG. 3 is an orthographic side view of the first arm secured to the chair.

An externally ribbed and internally threaded cylindrical boss 13 of a first diameter projects orthogonally outwardly of a side 11*a* and is formed with a series of three radially extending ribs 14 directed outwardly and coextensively axially of the exterior surface of said boss and spaced a first distance from side 11*a*. A pivotally mounted brace member 15 is secured to the cylindrical boss 13 and includes a first arm 16 with an internally splined pivot junction 16*a* securable about the boss 13. The pivot junction 16*a* includes a cylindrical bore of a length substantially equal to the boss 13 with a series of three splined recesses to slidingly and selectively receive the ribs 14 in one of three positions, as illustrated in FIG. 3, to rotatably mount the first arm 16 in one of the three noted positions to accommodate an infant secured within the seat 11 and effect a desired flow of fluid from the infant feeding bottle "B". An externally threaded locking plug 17 including an enlarged shoulder 18 is received within the boss 13 to lock the first arm 16 in a selected position onto boss 13. The shoulder 18 is of a diameter to exceed that defined by the internally threaded bore of boss 13. A flexible tether line 19 secures the plug 17 relative to the first arm 16 to prevent loss of the plug.

Figure 7:
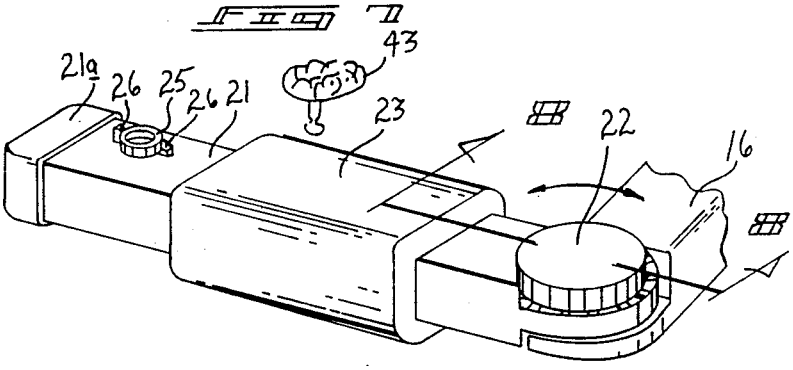
FIG. 7 is an isometric illustration of section 7 of FIG. 1.
Figure 8:
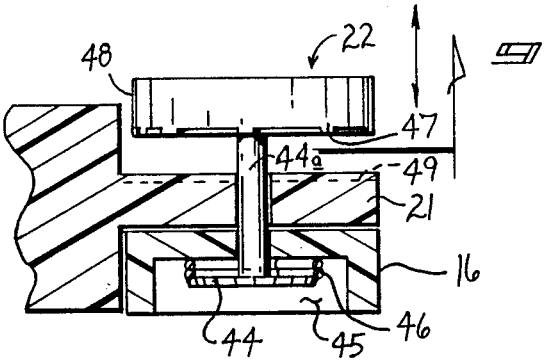
FIG. 8 is an orthographic side view taken along the lines 8—8 of FIG. 7 in the direction indicated by the arrows.
Figure 9:
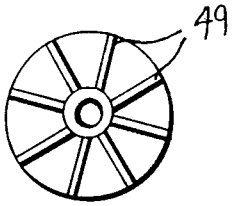
FIG. 9 is an orthographic bottom view taken along line 9 of FIG. 8 in the direction indicated by the arrows.
Figure 10:
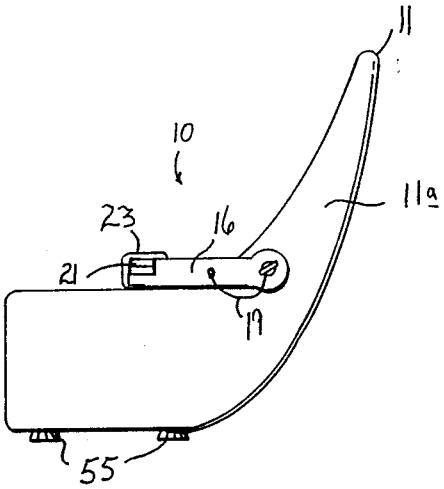
FIG. 10 is an orthographic side view taken in elevation of the chair.
Figure 11:
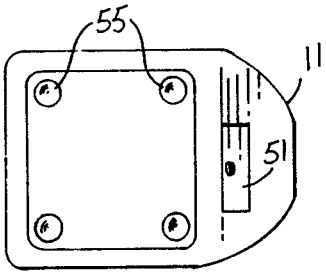
FIG. 11 is an orthographic bottom view of the chair of the instant invention.

The first arm is adjustably mounted to a second arm 21 of a length to extend medially of a distance defined between sides 11*a* in a pivot junction 22. The pivot junction 22, as illustrated in FIGS. 1 and 7, is selectively locked into a variety of orientations to selectively position pre-set the first and lock arm 16 relative to the second arm 21. A resiliently mounted latch 22 is axially repositionable to a pivot connection between the first and second arms 16 and 21 to include a first cylindrical plate 44 received within a cylindrical cavity 45 at a forward terminal end of the first arm 16 to capture spring 46 about a pivot axle 44*a* orthogonally secured to an upper surface of the first cylindrical plate 44 and directed through the pivot connection between the first and second arms 16 and 21. An upper end of the pivot axle 44*a* is secured to a second cylindrical plate 48 including a series of radial first ribs 47 equally spaced about an underlying surface of the second cylindrical plate 48. The first ribs 47 cooperate with first radial splines 49 formed on an undercut surface formed at a terminal end of the second arm 21 overlying the cylindrical cavity 45. Lifting of the latch 22 enable relative rotation of the second arm relative to the first arm and wherein, as eight radial first strips 47 cooperate with eight splines 49, the second arm 21 is positionable in four relative rotatively oriented positions relative to the first arm 16.

The second arm 21 includes a removable padded bumper 23 therearound, securable at the arm 21 by use of hook and loop fasteners. The padded bumpers 23 may be removed for cleaning and the like. The second arm 21 extends medially across forward portion of the chair and terminates in a padded rubber cap 21*a* on the end of the arm.

Positioned between the padded bumpers 23 and cap 21*a* is an upstanding tubular mount 25 formed with a plurality of diametrically opposed flange abutments 26 aligned with the second arm 21 and formed with an interior bore 27. The interior bore 27 has positioned medially therealong its length a circumferential projection directed inwardly of the bore 27 to cooperate slidably with a circumferential recess 29 formed within a cylindrical stem 30 of a diameter substantially equal to that of bore 27. The circumferential projection 28 is relatively resilient and enables the stem 30 to be pressed into the bore 27 and received therewithin and assisted thereby by use of a hemispherical end 30*a* forming a terminal lowermost of the stem 30. The stem 30 is axially and integrally formed to a support shank 31 terminating in an arcuate top surface defining a saddle 32 for receiving an infant nursing bottle thereon in a relatively conforming relationship. A transparent polymeric strap 33 is formed with a first end 32*a* and a second end 32*b* wherein the respective first and second ends 32*a* and 32*b* are provided with hook and loop fasteners 34 for adjustable securement about the associated baby bottle "B", as noted. The strap 33 enables an individual to visually observe a quantity of fluid remaining in the bottle "B".

Termination of nursing enables a padded stem 43 (see FIG. 7) formed with a relatively resilient uppermost end to be received replaceably within the tubular mount 25 to prevent injury to an infant upon removal of the support shank and associated nursing structure therewith.

A storage chamber 50 is directed interiorly through a rear surface of the chair 11 and includes a pivotally mounted door 51 hingedly mounted at its upper end and formed with a rotatable latch 52 at a position proximate its lower end. The latch 52 includes a rotatably tongue 53 receivable within a slot 54 formed proximate a forward terminal end of the storage chamber 50 for securement of infant paraphernalia therein, such as additional baby bottle, etc. The bottom surface of the chair 11 includes a plurality of downwardly extending pairs of friction feet 55 adjacent opposed corners of the bottom surface of the chair 11 to provide a non-slip securement means for positioning of the chair upon a desired surface.

Figure 2:
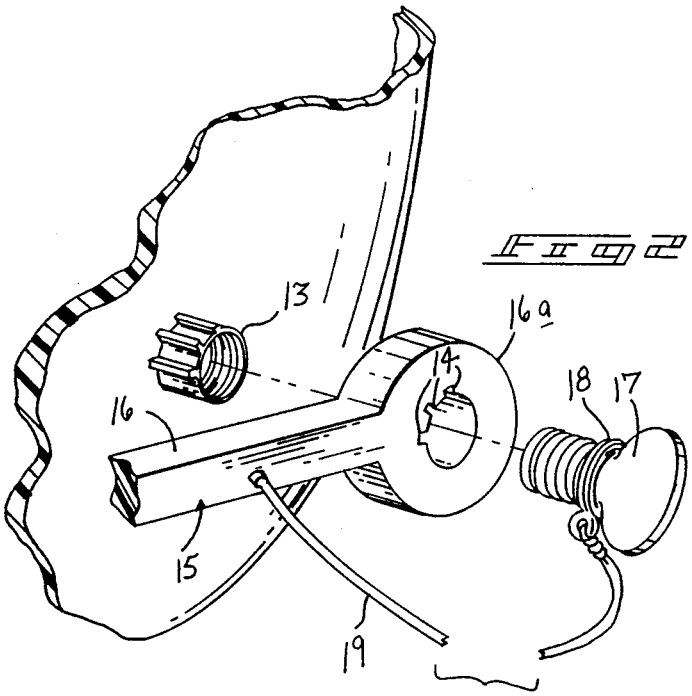
FIG. 2 is an isometric illustration somewhat expanded of the first arm of the chair secured thereto, as set forth in section 2 of FIG. 1.
Figure 4:
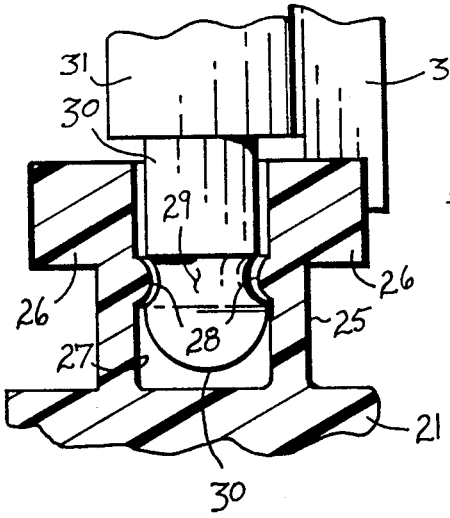
FIG. 4 is an orthographic cross-sectional view of the bottle mount rotatably secured within its base.
Figure 5:
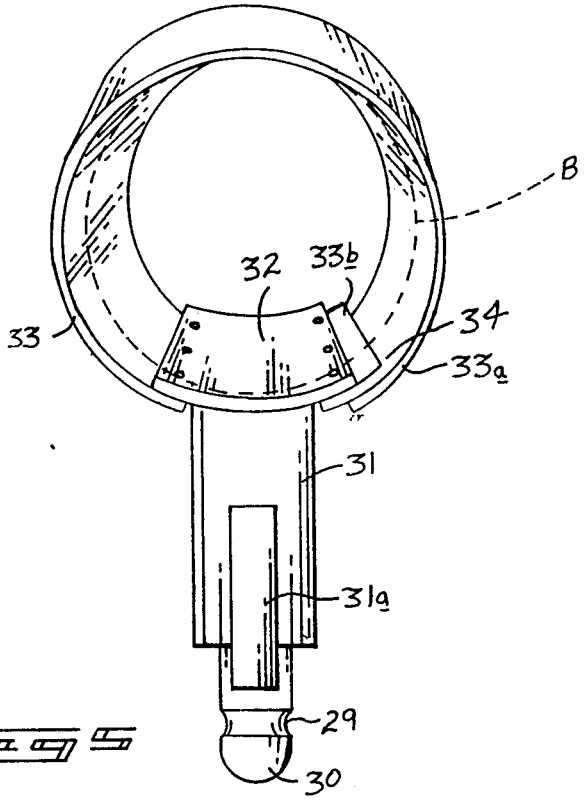
FIG. 5 is an expanded isometric illustration of the infant bottle mounting member.
Figure 6:
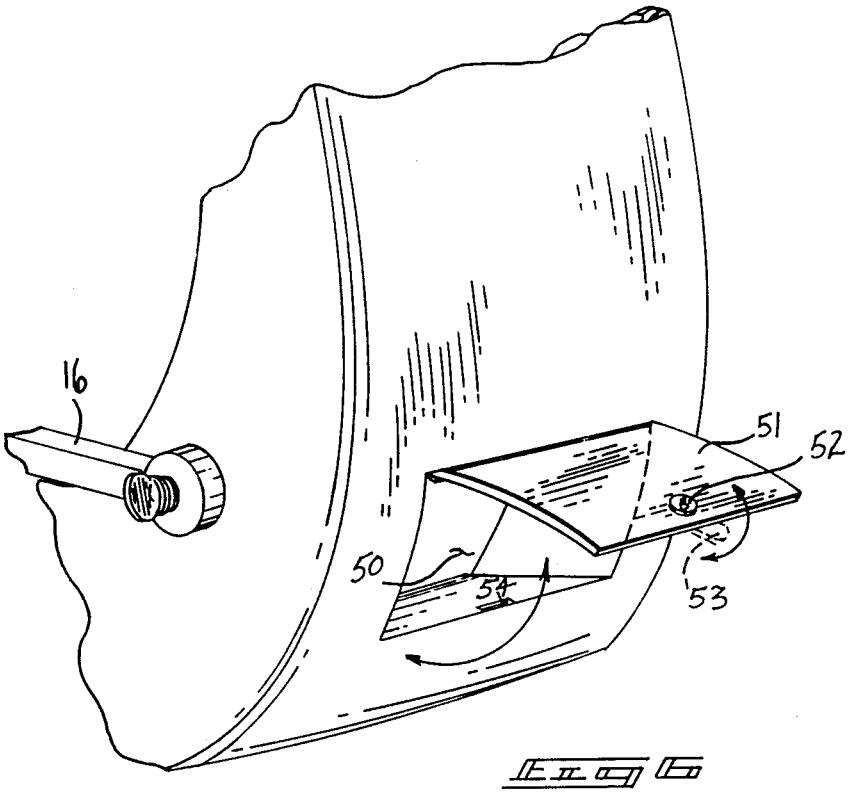
FIG. 6 is a rear isometric illustration of the compartment formed in a rear surface of the chair.

It is to be understood that there is an abutment arm 31*a*, as illustrated in FIGS. 2 and 4 for example, projecting diametrically outwardly of the support shank 31 and projecting downwardly and positioned in use forwardly of the flange abutments 26 whereupon the nursing bottle "B" may be pivoted in a limited arc of generally one hundred eighty degrees to limit rotation of the nursing bottle "B" and present the forward end of the bottle in an orientation to be utilized by an infant.

As to the manner of usage and operation of the instant invention, the same should be apparent from the above description and accordingly no further discussion relative to the manner of usage and operation of the instant invention shall be set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant feeding chair comprising, a substantially "L" shaped chair formed with parallel sides joined to a back and support base, and a first arm member pivotally mounted to one of said sides at a first pivot junction, and said first arm including a second pivot junction spaced from the first pivot junction and a second arm joined to said first arm at said second pivot junction, and said second arm including an upwardly projecting mount pivotally accepting a support shank, said support shank including a flexible adjustable strap means for securement of an infant bottle thereon, and wherein said second arm at the second pivot junction is pivotal to one of a plurality of positions relative to said first arm the second pivot junction including a latch member to latch said first arm to said second arm wherein said latch member is manually manipulatable and orthogonally displaceable relative to the first and second arms to pivotally release the second arm relative to the first arm.

2. An infant feeding chair as set forth in claim 1 wherein said mount includes an interior bore formed with a generally resilient circumferential projection directed into said bore, and said support shank includes a downwardly projecting cylindrical stem formed with a cylindrical recess matingly accepting said circumferential projection therein.

3. An infant feeding chair as set forth in claim 2 wherein said support shank further includes an abutment arm of generally "L" shaped configuration directed downwardly from said support shank and cooperating with a plurality of diametrically opposed flange abutments aligned with said second arm to permit pivotment of said support shank within one hundred eighty degrees of arc relative to said mount.

4. An infant feeding chair as set forth in claim 3 wherein said flexible strap is transparent and is formed with terminal ends wherein said terminal ends include hook and loop fasteners for adjustable securement of said support strap about an infant bottle.

5. An infant feeding chair as set forth in claim 5 further including an internally threaded cylindrical boss orthogonally fixed to and extending outwardly of one said sides of said chair with a plurality of elongate ribs axially aligned and integrally fixed to an exterior wall of the boss, and an end of said first tongue remote from said pivot junction including a splined bore for selective securement overlying said ribs in a plurality of angular orientations of said first arm relative to said cylindrical boss, and a threaded locking plug formed with an enlarged head threadedly received within said internally threaded boss to secure said first arm relative to said boss in a predetermined orientation.

6. An infant feeding chair as set forth in claim 5 wherein the latch member of said second pivot junction includes a first cylindrical plate formed with an orthogonal axle directed through the second pivot junction with a spring captured between the first cylindrical plate and an interior surface of the first arm, and a second cylindrical plate formed with a series of radially oriented ribs receivable within a complementary configuration of splines formed within a top surface of the second arm to selectively secure the second arm relative to the first arm in a predetermined orientation.

7. An infant feeding chair as set forth in claim 6 further including a compartment formed through a rear surface of the chair with a hinged door pivotally mounted at an upper edge thereof and including a latch mechanism to selectively secure the pivoted door to overlie the compartment.

* * * * *